US010962340B2

(12) United States Patent
Ohlson

(10) Patent No.: US 10,962,340 B2
(45) Date of Patent: Mar. 30, 2021

(54) MOBILE CHAMBER FOR THE STORAGE OF FLAMMABLE AND DETONABLE OBJECTS

(71) Applicant: OLCON ENGINEERING AB, Kil (SE)

(72) Inventor: Johnny Ohlson, Kil (SE)

(73) Assignee: OLCON ENGINEERING AB, Kil (SE)

( * ) Notice: Subject to any disclaimer, the term of this patent is extended or adjusted under 35 U.S.C. 154(b) by 167 days.

(21) Appl. No.: 16/077,073

(22) PCT Filed: Feb. 21, 2017

(86) PCT No.: PCT/SE2017/050165
§ 371 (c)(1),
(2) Date: Aug. 10, 2018

(87) PCT Pub. No.: WO2017/146634
PCT Pub. Date: Aug. 31, 2017

(65) Prior Publication Data

US 2019/0041180 A1 Feb. 7, 2019

(30) Foreign Application Priority Data

Feb. 22, 2016 (SE) ..... 1630029-5

(51) Int. Cl.
*F42B 39/14* (2006.01)
*F42D 5/045* (2006.01)

(52) U.S. Cl.
CPC ..... *F42B 39/14* (2013.01); *F42D 5/045* (2013.01)

(58) Field of Classification Search
CPC ..... E05G 1/024; B65F 1/0013; A62C 3/002; A62C 3/0235; F42B 39/14; F42D 5/045
See application file for complete search history.

(56) References Cited

U.S. PATENT DOCUMENTS 3,268,107 A 8/1966 Sperling
6,938,533 B2 * 9/2005 Holland ..... B65F 1/1426 86/50

(Continued)

FOREIGN PATENT DOCUMENTS

DE 9100620 U1 * 5/1991 ..... B65F 1/0066
DE 9100620 U1 5/1991

(Continued)

OTHER PUBLICATIONS

International Search Report (dated May 2, 2017) for corresponding International App. PCT/SE2017/050165.

*Primary Examiner* — Anthony D Stashick
*Assistant Examiner* — L Kmet
(74) *Attorney, Agent, or Firm* — WRB-IP LLP

(57) ABSTRACT

A mobile fireproof and detonation-proof chamber for storage of flammable and detonable objects includes at least one detachable fireproof and detonation-proof container which is swing out from an inner detonation-proof position for storage of flammable- and detonable objects in the mobile chamber to an outer detonation-proof position outside the mobile chamber for loading and unloading fire- and detonation-proof objects, wherein the at least one fire- and detonation-proof container includes a fire-mitigating and detonation-mitigating insert arranged in a detachable manner.

9 Claims, 6 Drawing Sheets

(56) References Cited

U.S. PATENT DOCUMENTS

| | | | | |
|---|---|---|---|---|
| 2007/0131684 | A1* | 6/2007 | Cirillo | F42B 39/14<br>220/88.1 |
| 2012/0305567 | A1 | 12/2012 | Abbe | |

FOREIGN PATENT DOCUMENTS

| | | | |
|---|---|---|---|
| EP | 1260456 | A1 | 11/2002 |
| EP | 2950036 | A1 | 12/2015 |
| FR | 2859748 | A1 | 3/2005 |
| WO | 9607073 | A1 | 3/1996 |

* cited by examiner

MOBILE CHAMBER FOR THE STORAGE OF FLAMMABLE AND DETONABLE OBJECTS

BACKGROUND AND SUMMARY

The present invention relates to a mobile chamber for the storage of flammable and detonable objects.

The invention relates particularly to a mobile chamber for the storage of found or confiscated flammable and detonable objects of the pyrotechnic type, such as bangers, bomb batteries and rocket kits. The invention also relates to a mobile chamber for the storage of smaller homemade explosive devices, so-called IEDs (Improvised Explosive Devices).

Handling and storing pyrotechnic articles that have been confiscated or that have been found in public places, or are handled at retail outlets such as gas stations and department stores, is a growing problem. Flammable and detonable objects of the IED type that are found in public places, such as railway stations and airports, are also a growing problem.

Mobile fireproof and detonation-proof chambers are known in the literature. WO2012/114099 A2 describes a mobile fireproof and detonation-proof chamber built with double walls of a sandwich structure where the gap between the walls comprises an explosion-absorbing gel. The wall structure with double walls in combination with the detonation-absorbing gel between the walls provides a relatively good construction with explosion-absorbing characteristics. The sandwich structure also enables simple production at a relatively low cost.

The fireproof and detonation-proof chamber can for example be used as a waste container for storing small detonable objects in public places such as railway stations and airports.

However, it has been found that storing various types of flammable and detonable objects that are different in size and sensitivity can lead to problems when these are stored together in one chamber of the aforementioned type, for example through flash-over between the objects.

It is desirable to provide a mobile fireproof and detonation-proof chamber for the storage of various types of flammable and detonable objects that are different in size and sensitivity.

Thus, according to an aspect of the present invention, a mobile fireproof and detonation-proof chamber for the storage of flammable and detonable objects is provided, wherein the mobile chamber comprises at least one fireproof and detonation-proof container arranged in a detachable manner, which can be swung out from an inner detonation-proof position for the storage of the flammable and detonable objects in the mobile chamber to an outer non-detonation-proof position outside the mobile chamber for loading and unloading the flammable and detonable objects, wherein the aforementioned at least one fireproof and detonation-proof container comprises a fire-mitigating and detonation-mitigating insert arranged in a detachable manner.

According to further aspects of the fireproof and detonation-proof chamber according to the invention, provision is made as follows:

that the mobile chamber is box-shaped with rectangular cross section comprising two side parts, a rear part, a base part, a roof part and at least one front openable and lockable door, that the aforementioned at least one inner fireproof and detonation-proof container is cylindrical, that the aforementioned at least one detachable fire-mitigating and detonation-mitigating insert is divided into a cylindrical sheath part with a perforated double wall and a cylindrical base part with a perforated single wall, wherein the space in the double wall and the space in the base part are filled with plastic containers containing water, that the perforated double wall and the perforated single wall are formed by an expander metal, that the aforementioned at least one fireproof and detonation-proof container is formed by three fireproof and detonation-proof containers, an upper container, an intermediate container and a lower container, wherein each, or a combination thereof, can be swung out from the inner detonation-proof position to the outer non-detonation-proof position, that the mobile chamber comprises three lockable doors that can be swung out, an upper door, an intermediate door and a lower door, on whose insides the three fireproof and detonation-proof containers that can be swung out are mounted.

The present invention, according to an aspect thereof, now offers a fireproof and detonation-proof mobile chamber for the safe storage of various types of flammable and detonable objects, preferably pyrotechnic articles, that are different in size and sensitivity.

The inner fireproof and detonation-proof containers that can be swung out enable simple loading and unloading of smaller and larger pyrotechnic objects in separate fireproof and detonation-proof containers.

By removing one or more of the base parts of the fireproof and detonation-proof containers, storage of pyrotechnic objects that are more or less long, such as rockets, is enabled in the chamber.

The especially novel aspect of the mobile chamber is therefore its configuration with several inner fireproof and detonation-proof containers that can be swung out from an inner closed position to an open outer position independently of each other.

From the above, it will be clearly apparent that all activities associated with simultaneous storage of flammable and detonable objects of the pyrotechnic type, and of variable size and sensitivity, using the mobile chamber according to the invention, can be achieved without difficulty in a safe manner.

The mobile chamber according to the invention thus meets all the requirements that might be expected of a chamber of the aforementioned kind.

Further advantages and effects will emerge from study and consideration of the following detailed description of the invention, including one of its advantageous embodiments, the claims and the accompanying drawing figures.

BRIEF DESCRIPTION OF FIGURES

The invention has been defined in the following claims and will now be described somewhat further in conjunction with the appended figures, in which:

DETAILED DESCRIPTION

FIGS. 1-11 show a mobile fireproof and detonation-proof chamber 1 according to the invention, especially intended for the storage of flammable and detonable objects that are different in size and sensitivity.

The mobile chamber can preferably be used at police stations for the storage of found or confiscated pyrotechnic articles and/or at airports and railway stations for the storage of flammable and detonable objects of the IEDS type.

Figure 1:
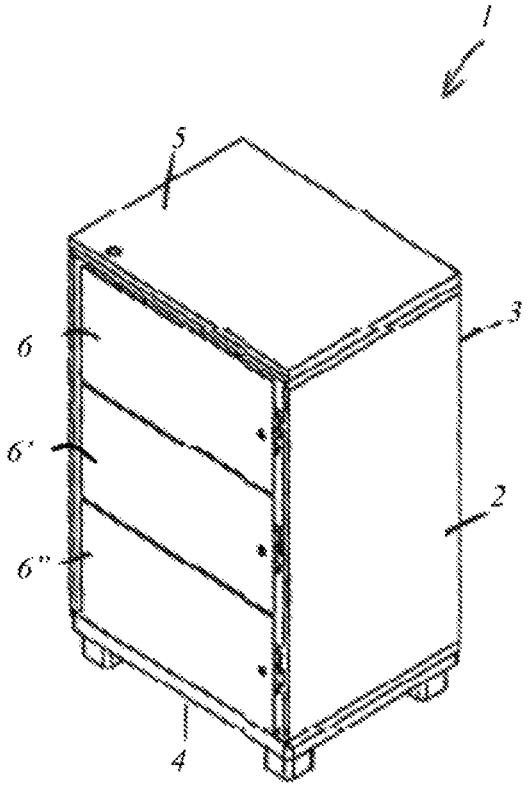
FIG. 1 shows a schematic view, seen obliquely from above, of a first embodiment of a mobile chamber according to the invention comprising three inner fireproof and detonation-proof containers that can be swung out and are intended for the simultaneous storage of flammable and detonable objects of variable size and sensitivity.
Figure 2:
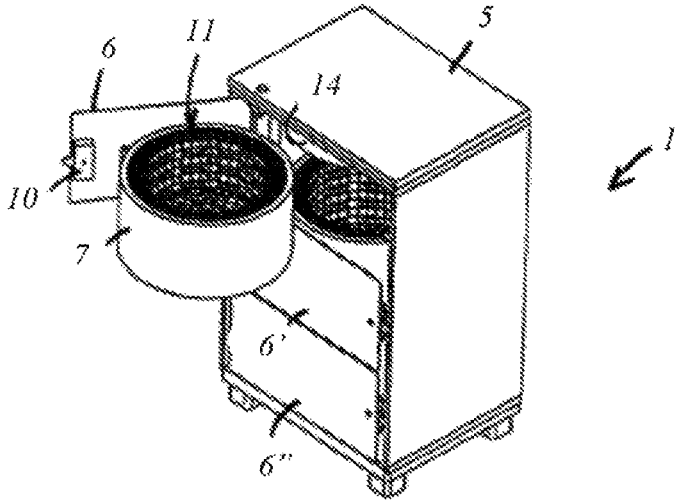
FIG. 2 shows a schematic view, seen obliquely from above, of the chamber according to FIG. 1, where the uppermost of the three containers that can be swung out is in an open, swung out position.
Figure 3:
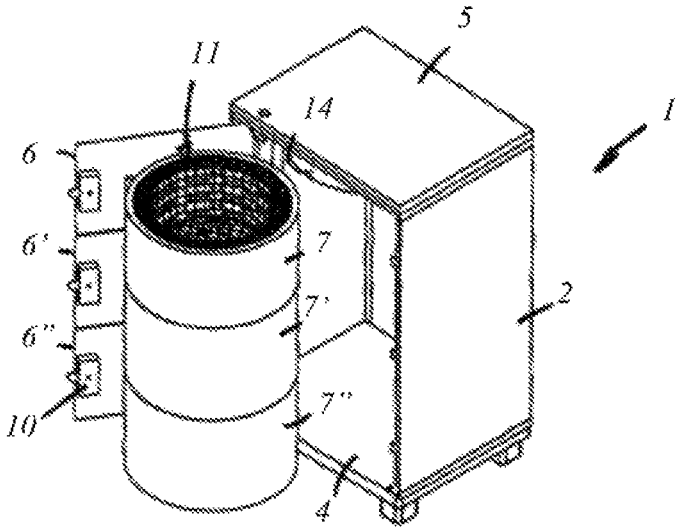
FIG. 3 shows a schematic view, seen obliquely from above, of the chamber according to FIG. 1, where the three fireproof and detonation-proof containers that can be swung out are in an open, swung out position.
Figure 4:
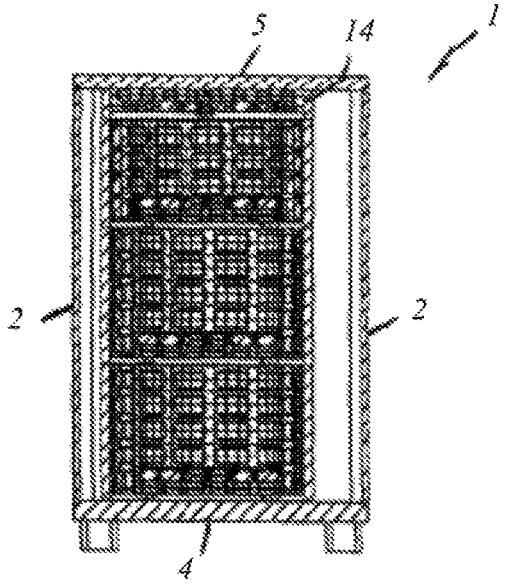
FIG. 4 shows a vertical longitudinal section of the three fireproof and detonation-proof containers in the chamber according to FIG. 1.
Figure 5:
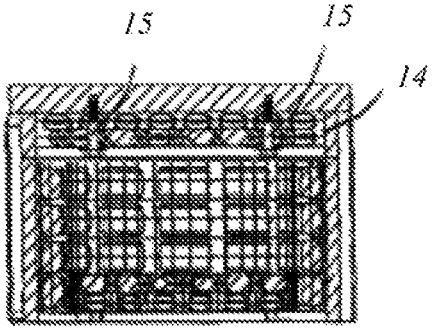
FIG. 5 shows an enlargement of a vertical longitudinal section of the uppermost of the three fireproof and detonation-proof containers including the fixedly mounted top part on the underside of the reinforced roof part of the chamber in the chamber according to FIG. 1.

In a first embodiment, FIGS. 1-3, the mobile chamber 1 is preferably box-shaped or case-shaped with square or rectangular cross section comprising two side parts 2, a rear part 3, a base part 4, a roof part 5 and at least one front openable and lockable door 6. The base part 4 and the roof part 5 are reinforced in order to cope with increases of pressure in a vertical direction caused by explosions in the chamber 1. The box-shaped mobile chamber 1 preferably has a width of 500 mm, a depth of 390 mm and a height of 750 mm.

The box-shaped chamber 1 is arranged with three fireproof and detonation-proof containers that can be swung out, an upper container 7, an intermediate container 7' and a lower container 7". The three containers 7, 7', 7" can be swung out, separately or in combination, from an inner closed position which is fireproof and detonation-proof to an outer non-detonation-proof position for loading and unloading the flammable and detonable objects.

In the first embodiment, the chamber 1 is arranged with three openable and lockable doors, an upper door 6, an intermediate door 6' and a lower door 6" on whose respective insides the three fireproof and detonation-proof containers 7, 7', 7" are mounted.

The upper fireproof and detonation-proof container 7 has a height of preferably 180 mm while the intermediate container 7' and the lower container 7" have a height of preferably 227 mm.

Figure 10:
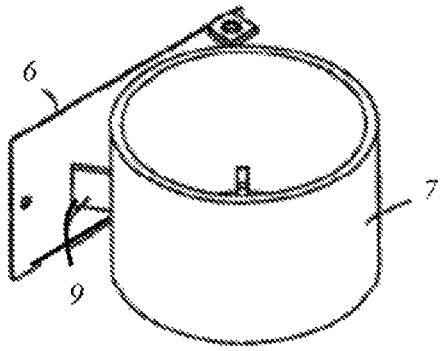
FIG. 10 shows a view, seen obliquely from above, of the openable door with the mounted fireproof and detonation-proof container according to FIG. 1.
Figure 11:
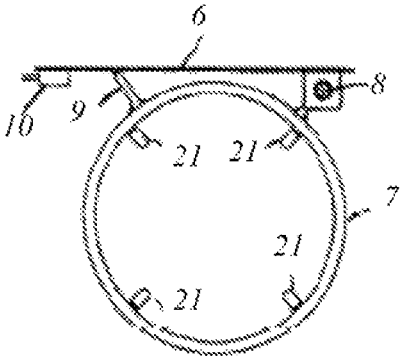
FIG. 11 shows a view, seen from above, of the openable door with the mounted fireproof and detonation-proof container according to FIG. 1.

The three containers 7,7', 7" are preferably mounted in a pivoting or swiveling manner on vertical axes on the insides of the doors 6, 6', 6" using inner hinges 8, FIG. 10. Alternatively, the containers 7, 7', 7" are fixedly mounted on the insides of the doors 6,6', 6" using welded or bolted joints, not shown, or detachably mounted by any suitable structure such as hinges 8. On the outsides of the containers 7, 7', 7", damper stops 9 are also arranged for dampening impacts between the rotatable containers 7, 7', 7" and the insides of the doors 6, 6', 6" when the doors 6, 6', 6" are opened and closed. The damper stops 9 are formed by, for example, rubber-coated angle bars attached to the outsides of the containers 7, 7', 7". Alternatively, the damper stops 9 are formed by protruding rubber-coated pegs or pins, not shown.

The doors 6, 6', 6" are preferably mounted on outer hinges of reinforced type, mounted on a vertical axis, which extends from the roof part 5 of the chamber 1 to the lower part 4 of the chamber 1 in mounts provided. The doors 6, 6', 6" are also equipped with reinforced lock devices 10 for intrusion-proof storage.

Figure 6:
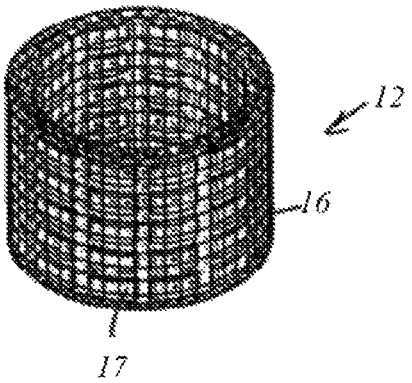
FIG. 6 shows a view, seen obliquely from above, of the sheath part of the fire-mitigating and detonation-mitigating insert in the fireproof and detonation-proof containers in the chamber according to FIG. 1.
Figure 7:
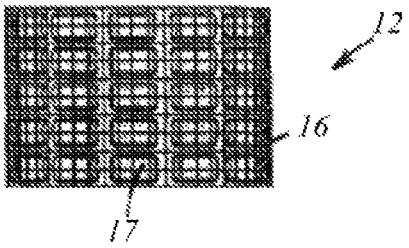
FIG. 7 shows a view, seen from the side, of the sheath part of the fire-mitigating and detonation-mitigating insert in the fireproof and detonation-proof containers in the chamber according to FIG. 1.
Figure 8:
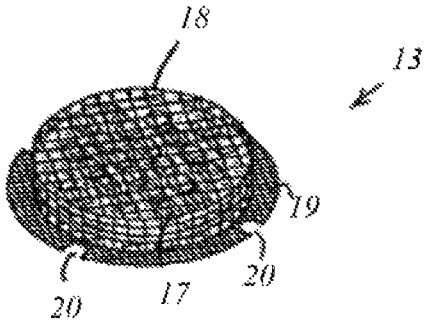
FIG. 8 shows a view, seen obliquely from above, of the base part of the fire-mitigating and detonation-mitigating insert in the fireproof and detonation-proof containers in the chamber according to FIG. 1.
Figure 9:
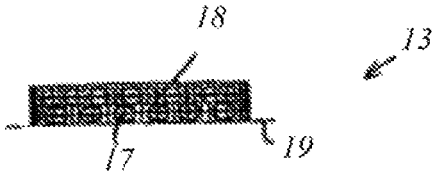
FIG. 9 shows a view, seen from the side, of the base part of the fire-mitigating and detonation-mitigating insert in the fireproof and detonation-proof containers in the chamber according to FIG. 1.

The three fireproof and detonation-proof containers 7, 7', 7" are preferably cylindrical and arranged with detachable fire-mitigating and detonation-mitigating inserts 11, FIGS. 2-5, wherein the inserts 11 comprise a fire-mitigating and detonation-mitigating sheath part 12, FIGS. 6-7, and a fire-mitigating and detonation-mitigating base part 13, FIGS. 8-9.

The intermediate base parts 13 also form top or roof parts for the lower container 7" and the intermediate container 7'. By omitting one or several of the intermediate base parts 13, the three containers 7, 7', 7" can be combined so that they together provide containers of different sizes, wherein the lower container 7" can be combined with the intermediate container 7', the intermediate container 7' can be combined with the upper container 7" and the lower container 7" can be combined with the intermediate container 7' and with the upper container 7.

On the underside of the reinforced roof part 5 of the chamber 1, a cylindrical top part 14 is mounted, comprising a fire-mitigating and detonation-mitigating insert of the same type as the fire-mitigating and detonation-mitigating base part 13 of the three fire-mitigating and detonation-mitigating containers 7, 7', 7", wherein the cylindrical top part 14 and the fire-mitigating and detonation-mitigating base part 13 form the top part of the upper container 7, alternatively, also the top part of several containers 7, 7', 7" if these are combined as described earlier. The top part 14 with the fire-mitigating and detonation-mitigating base part 13 is preferably fixedly mounted on the underside of the reinforced roof part 5 of the chamber 1 using screws 15 or bolts, FIG. 5.

In the aforementioned first embodiment of the chamber 1, the fire-mitigating and detonation-mitigating sheath part 12, FIG. 6, is formed by an open cylindrical container with double perforated walls 16 that include elastic plastic containers 17, which contain water, arranged in the space between the double perforated walls 16.

The plastic containers 17 with water are intended to mitigate the detonation pressure as well as cool and absorb the detonation gases that develop during ignition or detonation of one or more pyrotechnic objects or objects containing an explosive substance, and they may be of various size and shape.

The plastic containers 17 with water are preferably cushion-shaped with a water content in the range of 50 to 200 ml, preferably 100 ml. Alternatively, the plastic containers 17 may be pipe-shaped or hose-shaped with a length that preferably corresponds to the inner periphery of the sheath 12. FIG. 6 shows a view seen obliquely from above and FIG. 7 shows a side view of the fire-mitigating and detonation-mitigating sheath part 12.

A closed cylindrical container with perforated single walls 18 forms the fire-mitigating and detonation-mitigating base part 13, FIGS. 8-9. The diameter of the base part 13 is the same as the inner diameter of the sheath part 12. A disk-shaped flange 19 of perforated metal is mounted on the underside of the base part 13, having an outer diameter corresponding to the outer diameter of the sheath part 12, alternatively to the outer diameter of the containers 7, 7', 7". Four mounting cavities 20 are arranged on the periphery of the flange 19 for attaching the base part 13 to the insides of the containers 7, 7', 7", or to the undersides using four corresponding fastening devices 21, preferably of screw type, that are arranged on the lower part of the inner walls of the containers 7, 7', 7". Other types of fastening devices can also be used.

The perforated walls 16, 18 of the sheath part 12 and of the base part 13 are preferably formed by an expanded metal of any commercially available type, preferably with a mesh length and a mesh width in the range of: 20-50 mm and 5-10 mm respectively. Other types of expanded metal with other dimensions can also be used. If necessary, perforated sheet metal, welded grating or conventional steel mesh can also be used.

The fire-mitigating and detonation-mitigating inserts 11 are mounted in the fireproof and detonation-proof containers 7, 7', 7" by inserting the cylindrical base parts 13 into the cylindrical cavities in the sheath parts 12, after which the sheath parts of the inserts 11 are inserted, from underneath, into the cylindrical cavities of the containers 7, 7', 7", after which the inserts 11 are fixed to the undersides of the containers 7, 7', 7" using fastening devices 21 and mounting cavities 20 intended therefor.

The invention claimed is:

1. A mobile fire and detonation protective chamber for the storage of flammable and detonable objects, comprising at least one fire and detonation protective container arranged in a detachable, pivotable, or fixedly mounted manner on at least one front openable and lockable door which enables the at least one container to be swung out from an inner fire and detonation protective position for the storage of the flammable and detonable objects in the chamber to an outer non-fire-protective and non-detonation-protective position outside the chamber for loading and unloading the objects, wherein the at least one container comprises a fire-mitigating and detonation-mitigating insert arranged in a detachable manner, and a top part mounted on an underside of a roof part of the chamber, wherein the at least one container comprises three containers including an upper container, an intermediate container and a lower container, wherein each of the three containers, or a combination of one or more of the three containers, can be swung out from the inner fire and detonation protective position to the outer non-fire-protective and non-detonation-protective position.

2. The mobile fire and detonation protective chamber as claimed in claim 1, wherein the fire and detonation protective chamber is box-shaped with rectangular cross section comprising two side parts, a rear part, a base part, a roof part and the at least one front openable and lockable door.

3. The mobile fire and detonation protective chamber as claimed in claim 1, wherein the at least one container is an inner container that is cylindrical.

4. The mobile fire and detonation protective chamber as claimed in claim 1, wherein the insert is divided into a cylindrical sheath part with a perforated double wall and a cylindrical insert base part with a perforated single wall, wherein a space in the double wall and a space in the insert base part are filled with plastic containers containing water.

5. The mobile fire and detonation protective chamber as claimed in claim 4, wherein the perforated double wall and the perforated single wall are formed by an expander metal.

6. The mobile fire and detonation protective chamber as claimed in claim 1, wherein the chamber comprises three doors that can be swung out, corresponding ones of the three containers being mounted in a detachable, pivotable, or fixedly mounted manner on insides of the three doors.

7. A protective and detonation protective chamber for the storage of flammable and detonable objects, comprising at least one fire protective and detonation protective container arranged in a detachable, pivotable, or fixedly mounted manner on at least one front openable and lockable door which enables the at least one container to be swung out from an inner fire and detonation protective position for the storage of the flammable and detonable objects in the chamber to an outer non-fire-protective and non-detonation-protective position outside the chamber for loading and unloading the objects, wherein the at least one container comprises a fire-mitigating and detonation-mitigating insert arranged in a detachable manner, and a top part mounted on an underside of a roof part of the chamber, wherein the insert is divided into a cylindrical sheath part with a perforated double wall and a cylindrical base part with a perforated single wall, wherein a space in the perforated double wall and a space in the cylindrical base part are filled with plastic containers containing water.

8. A fire protective and detonation protective chamber for the storage of flammable and detonable objects, comprising at least one fire protective and detonation protective container arranged in a detachable, pivotable, or fixedly mounted manner on at least one front openable and lockable door, which enables the at least one container to be swung out from an inner fire and detonation protective position for the storage of the flammable and detonable objects in the chamber to an outer non-fire-protective and non-detonation-protective position outside the chamber for loading and unloading the objects, wherein the at least one container comprises a fire-mitigating and detonation-mitigating insert arranged in a detachable manner, and a top part mounted on an underside of a roof part of the chamber, wherein the chamber comprises three doors that can be swung out, the at least one container comprises three containers, corresponding ones of the three containers being mounted in a pivotable or fixedly mounted manner on insides of the three doors such that each of the three containers, or a combination of one or more of the three containers, can be swung out from the inner fire and detonation protective position to the outer non-fire-protective and non-detonation-protective position.

9. The mobile fire and detonation protective chamber as claimed in claim 1, wherein the detachable insert has an exterior geometrical shape that is substantially the same as an interior shape of the at least one container.

* * * * *